United States Patent [19]

Paleschuck

[11] Patent Number: 4,680,808

[45] Date of Patent: Jul. 14, 1987

[54] COMPACTOR RECEPTACLE

[76] Inventor: Maurice Paleschuck, 140 Redwood Dr., Roslyn, N.Y. 11576

[21] Appl. No.: 816,061

[22] Filed: Jan. 3, 1986

[51] Int. Cl.[4] ..... B65D 33/10

[52] U.S. Cl. ..... 383/9; 383/24; 383/98; 53/527; 100/122; 100/229 A

[58] Field of Search ..... 383/6, 7, 9, 12, 26, 383/30, 31, 33, 98, 2, 117, 120, 73, 102; 53/523, 526, 527, 529; 220/404; 100/122, 229 A

[56] References Cited

U.S. PATENT DOCUMENTS

| | | | |
|---|---|---|---|
| 2,468,897 | 5/1949 | Rothe | 383/22 |
| 2,487,145 | 11/1949 | Kuhlman | 383/13 |
| 2,795,258 | 6/1957 | Berry et al. | 383/98 |
| 2,826,138 | 3/1958 | Pexton | 100/122 |
| 3,257,090 | 6/1966 | Frazier | 383/24 |
| 3,592,127 | 7/1971 | Cooley | 100/122 |
| 3,756,144 | 9/1973 | Engebretsen | 383/7 |
| 3,805,691 | 4/1974 | Sulcek | 53/527 |
| 3,938,731 | 2/1976 | Ross, Jr. et al. | 383/98 |
| 4,084,497 | 4/1978 | Khan | 53/527 |
| 4,479,243 | 10/1984 | Derby et al. | 383/6 |

*Primary Examiner*—Willis Little

*Attorney, Agent, or Firm*—Leonard Belkin

[57] ABSTRACT

A receptacle for use in compacting liquid laden trash and removal of liquid from said trash. The receptable is a bag made from a porous fabric of hydrophobic material which resists leakage of the liquid within the trash. The bag is crushed within a compactor causing liquid to pass out through the wall of the bag. The receptacle includes means to suspend the bag with the opening up in the compactor and to close the opening once the receptacle is removed from the compactor. A handle on the receptacle facilitates removal of the filled receptacle.

16 Claims, 6 Drawing Figures

FIG. 1
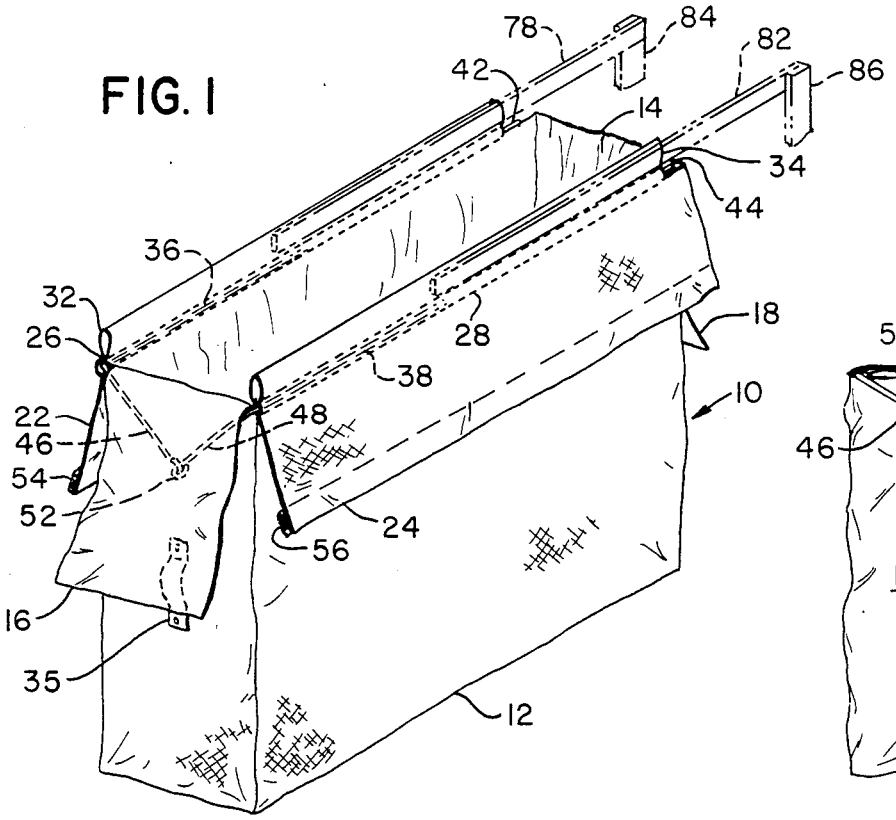
FIG. 4
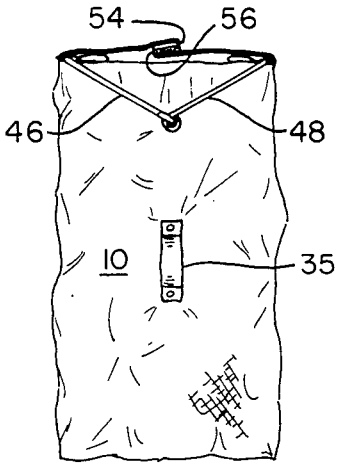
FIG. 2
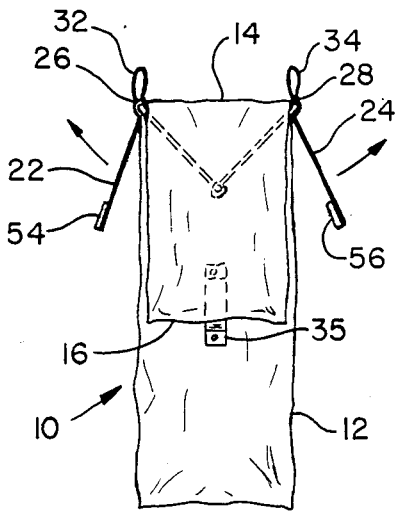
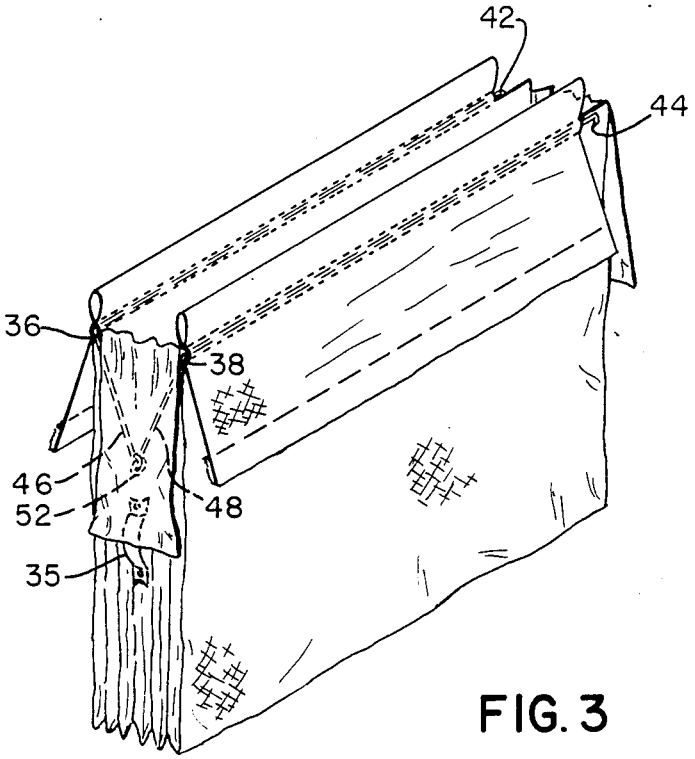
FIG. 3

COMPACTOR RECEPTACLE

BACKGROUND OF THE INVENTION

This invention relates to a trash collection receptacle for use in a compactor and more particularly to a collection bag useful in an airborne refuse compactor.

In my U.S. Pat. No. 4,444,099 there is disclosed an airborne refuse compactor in which cabin pressure is utilized to energize the device and to withdraw during compaction the liquid content of the refuse through a self-closing valve which is part of and penetrates the wall of the refuse receptacle. In the patent, the liquid is discharged into the rarefied atmosphere during flight.

It is readily seen that the receptacle to be employed in the compactor disclosed in my patent must be of generally rigid construction in order to conform to the cavity within the compactor and to accommodate the piston and the one-way valve. Thus the receptacles must occupy valuable space aboard the aircraft prior to use in the compactor or be made collapsible at a significant cost.

In addition, in the aforementioned patent, the compactor employs a piston or platen filling the entire cross section of the receptacle to compress the refuse within. After a series of cycles, when the receptacle is filled, the latter is removed. A single piston is not capable of adjusting readily to different kinds or densities of the trash over its area with the result that there is sometimes a tendency for the piston to become cocked. In addition, the single piston along with its actuating structure is complicated and heavy and contributes significantly to the weight of the compactor.

SUMMARY OF THE PRESENT INVENTION

The present invention improves the performance and usefulness of airborne refuse compactors by providing a receptable for the collection of the refuse which is far less expensive to manufacture, lacks the need for a valve for the withdrawal of the liquid within the refuse, and can be collapsed completely prior to use occupying very little valuable space.

In accordance with the principles of this invention, a preferred embodiment comprises a receptacle for use in a compactor for the collection of refuse and adapted to be crushed thereby compacting the refuse contained therein. The receptable consists of a bag made from a porous fabric of a hydrophobic or nonwetting material such as nylon having provision to suspend it with the open end up in the compactor. Adjacent the open end of the bag there is provided extended metal arms to facilitate insertion and removal of the bag and to guide the sides of the opening during compaction.

The material out of which the bag is constructed will resist leakage of the liquid in the trash as the bag is being filled due to the non-wetting characteristics of the fibers while during compaction the liquid will leak out of the bag and collect in the bottom of the compactor where it can be carried away so that when the bag is full and ready to be removed and discarded the trash is largely free of liquid thereby reducing the effort required in disposing of the trash.

It is thus a principal object of this invention to provide method and apparatus for the disposal of liquid laden trash.

Another object of this invention is a receptacle for the compaction of liquid laden trash and the simultaneous removal of the liquid.

Other objects and advantages of this invention will hereinafter become obvious from the following description of preferred embodiments of this invention.

BRIEF DESCRIPTION OF THE DRAWINGS

FIG. 1 is an isometric view of a receptacle embodying the principles of this invention.

FIG. 2 is an end view of the receptacle.

FIG. 3 is an isometric view of the receptacle partially collapsed.

FIG. 4 is an end view of the receptacle after being sealed.

DETAILED DESCRIPTION OF THE PREFERRED EMBODIMENT

Figure 6:
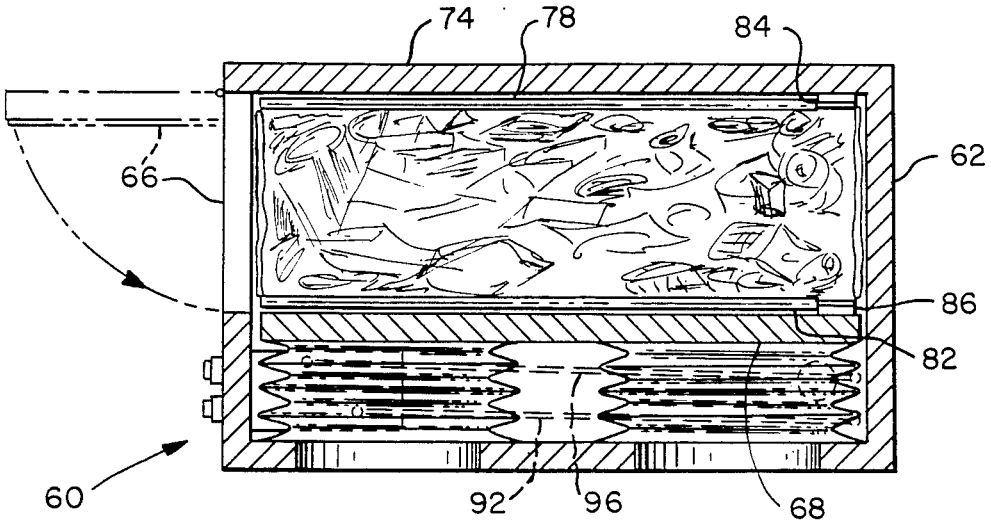
FIG. 6 is a plan view of the compactor of FIG. 5 with the top removed and partially schematized.

Referring to FIGS. 1–3, receptacle 10 consists of a bag 12 which is generally rectangular in cross section having an opening 14 at the top thereof and a pair of end flaps 16 and 18. Along the long dimension of bag 12 on both sides of opening 14 it will be seen that there are a pair of flaps 22 and 24 which are folded and stitched or otherwise attached at 26 and 28 to form a pair of elongated loops 32 and 34 for a purpose to be later described. A handle 35 is located at one end of bag 12 for a purpose also to be described later.

The stitching or other attachment along 26 and 28 represent each two rows of such attachment so as to accommodate a pair of extended rods 36 and 38 which at the far end terminate in a pair of dog legs 42 and 44, respectively. At the near end of receptacle 10 rods 36 and 38 terminate in a pair of arms 46 and 48 which are joined in a hinge 52.

In FIGS. 1 and 2 bag 12 is shown fully expanded with arms 46 and 48 are at a small angle with the top of bag 12 so that hinge 52 is below the top opening 14 of bag 12.

When bag 12 is compressed transversely as shown partially collapsed in FIG. 3 arms 46 and 48 along with hinge 52 drop down. When empty and completely collapsed, bag 12 is readily stored and shipped. When filled with trash and crushed as will be described later the hinge arrangement disclosed insures that hinge 52 along with arms 46 and 48 will move downwardly.

The exposed edges of flaps 22 and 24 are provided with a pair of Velcro strips 54 and 56 on opposite sides of the flap edges so that they will mate and seal receptacle 10 in a manner now to be described.

When receptacle 10 is filled with trash which has been crushed, it is closed and sealed after removal from the compactor as shown in FIG. 4. End flaps 16 and 18 are first folded over the opening 14, and then end flaps 22 and 24 are folded over as seen in FIG. 4 with Velcro strips 54 and 56 engaging each other. Receptacle 10 can then be carried away using handle 35.

Figure 5:
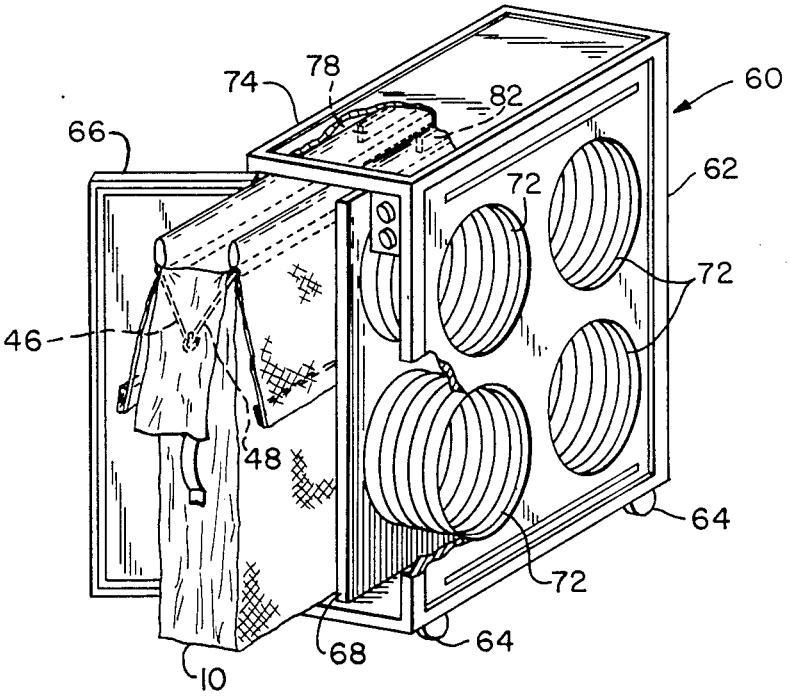
FIG. 5 is an isometric view partially cut away and partially schematized of a compactor with the door open to accommodate the receptacle.

For a description of how receptacle 10 may be employed in a compactor, reference is made to FIGS. 5 and 6.

Compactor 60 is a free standing or built-in unit with a housing 62 supported, in this configuration, by casters 64 with a door 66 for opening one end as illustrated.

Within housing 62 is a floating crusher plate 68 actuated by a plurality of bellows 72. With door 66 open, receptacle 10 is designed to be slipped into compactor 60 in the manner illustrated between crusher plate 68 and end wall 74.

To support receptacle 10 within compactor 60, the latter is provided within housing 62 between crusher plate 68 and end wall 74 near the top of the unit a support assembly consisting of a pair of extended, parallel arms 78 and 82 mounted on back wall 74 and crusher plate 68, respectively, by brackets 84 and 86, respectively, as seen in FIG. 1.

When receptacle 10 is inserted into compactor 60 and pushed by pivoted arms 46 and 48, parallel arms 78 and 82 enter and slide through loops 32 and 34, as seen also in FIG. 1, until receptacle 10 is entirely within compactor 10. The bottom of empty bag 12 rests on the floor of housing 62 for a reason to be described below.

When trash is to be inserted into receptacle 10, door 66 is opened, and, by grasping pivoted arms 46 and 48, receptacle 10 is partially pulled out to accommodate the deposit of trash. Dog legs 42 and 44 on the far end of rods 36 and 38 pull out bag 12. When bag 10 is full or almost full, with door 66 closed, bellows 72 are actuated to drive crusher plate 68 to compress bag 12 by exposing the space between crusher plate 68 and end wall 74 to a reduced air pressure using the vacuum system line 92 indicated schematically in FIG. 6. It has been found from test runs that when crusher plate 68 is retracted after a compression stroke, the compacted trash will break apart, dropping to the bottom of bag 12, leaving room for more trash. It has been found that application of suction to the space between plate 68 and wall 74 results in liquid within the trash passing out through the porous walls of bag 10 and collecting on the bottom of housing 62.

The cycle is repeated two or three times until there is no more room in receptacle 10. At that point, receptacle 10 is removed completely from compactor 60, and flaps 16 and 18 are folded over and side flaps are folded and sealed to permit filled receptacle 10 to be carried away by handle 35 as previously described. As receptable 10 becomes filled, it becomes supported largely by resting on the bottom of housing 62 thereby not increasing the load on the supporting members at the top of receptacle 10.

Typical trash collected aboard passenger aircraft contains about 50% by weight liquid, such as water, coffee, soft drinks, juices, etc. In order to make the most effective use of receptacle 10 as a trash collector, it is desirable to remove most of the liquid from the trash while receptacle 10 is still inside of compactor 60.

This is accomplished in the present invention by making bag 12 from a woven fabric material which is hydrophobic, that is, a non-wetting material such as dacron, nylon or other synthetic material. The material out of which bag 12 is constructed is porous, and it has been found that a bag made from 6¾ ounce dacron (per linear yard by 40 inches wide) will contain the liquid without leakage except when suction is applied to the space between crushing plate 68 and end wall 74 in which receptable 10 is located. When that occurs, within compactor 60, a good portion of the liquid within the trash will pass through the walls of bag 12, collecting on the bottom of compactor 60 where a suction drain line 96 as shown schematically in FIG. 6 is provided to carry the liquid into the liquid drain collection system of the aircraft, to collect the liquid within compactor 60 itself for later removal, or if permissible to be dumped overboard where liquid atomizes once it is exposed to the outside atmosphere. Also suitable for bag material is 5 ounce nylon material with a weave between about 120 and 170 denier.

While the details of construction and operation of compactor 60 do not form a part of the invention claimed herein, it should be noted that bellows 72, which may be made from a suitable material such as a metal alloy may be actuated by cabin pressure while provision would be made to expose at the same time the region between crusher plate 68 and back wall 74 which would include receptacle 10 to pressure outside of the aircraft cabin or an on-board vacuum system, in other words, to a pressure which is substantially less than atmospheric. Details of apparatus capable of providing such action is described in the aforementioned United States patent.

The trash collection receptacle described herein makes it possible to more efficiently deal with liquid laden trash aboard passenger aircraft by separating out the liquid and compacting the remaining trash so that more of it can be stored in any given space. The receptacle is inexpensive in construction and can be stored almost flat with very little space required. When filled with trash, it is conveniently sealed and can be carried away by ground personnel since the receptable is capable of storing relatively large amounts of trash by virtue of the compaction cycle employed.

While only preferred embodiments of this invention have been described it is understood that many variations of the invention are possible without departing from the principles of this invention as defined in the claims which follow.

What is claimed is:

1. In combination a compactor, a receptacle within said compactor for the collection of refuse and adapted to be crushed thereby to compact the trash contained therein, said receptacle comprising a bag with an open end and formed from a porous fabric of hydrophobic material capable of containing liquid in the absence of the application of a pressure in said liquid means adapted for suspending said bag with the open end up within said compactor, the latter said means including means adjacent the opening in said bag for facilitating the insertion and withdrawal of said bag into and out of said compactor, and said compactor including means for crushing the sides of said bag thereby compacting the refuse therein.

2. The receptable as recited in claim 1 in which said means adapted for suspending said bag comprises a pair of side flaps formed into a pair of loops, respectively.

3. The receptacle as recited in claim 2 in which said side flaps include means to close and seal the opening into said bag when said receptable is removed from said compactor filled with compacted trash.

4. The receptacle of claim 3 in which said bag is provided with end flaps to fold into said opening prior to closing of said side flaps.

5. The receptacle of claim 4 in which the bottom of said bag rests on the floor of said compactor so that as said bag is filled with trash, support of said receptacle is shifted to said compactor.

6. The receptacle of claim 1 in which said means adjacent the opening in said bag for facilitating the insertion and withdrawal of said bag comprises a pair of rods extending the length of said opening and a pair of arms attached to one end of said rods to pivot downwardly as said bag is being crushed in said compactor.

7. The receptacle of claim 6 in which said rods include means to engage said bag to permit said arms to be used to withdraw said receptacle from said compactor.

8. Apparatus for the compaction of liquid laden trash and withdrawal of liquid from said trash comprising, in combination, a receptacle of porous, hydrophobic flexible material to receive said trash and to contain said liquid in the absence of the application of pressure on said liquid a compactor to receive said receptacle having means actuated by differential air pressure to crush said receptacle and cause said liquid in said trash to pass out of said receptacle by way of said porous flexible material for collection within and disposal by said compactor, and means adapted to suspend said receptacle when empty within said compactor and thereafter close and seal the opening in said receptacle after removal from said compactor, said receptacle contacting the bottom of said compactor so that as the former becomes filled with trash support of said receptacle is shifted to said compactor.

9. The apparatus of claim 8 in which said actuated means includes a plate to squeeze said bag against a side wall of said compactor.

10. The method of compacting and removing liquid from liquid laden trash comprising the steps of inserting said trash in a bag made from a porous fabric of hydrophobic material capable of containing said liquid in the absence of the application of pressure, applying differential pressure to crush said bag to compact the trash therein and cause liquid in said trash to emerge from said bag through said porous fabric, and closing the opening into said bag.

11. The method of claim 10 in which said bag is crushed while mounted within a compactor, said bag being removed from said compactor for closing said opening.

12. The method of claim 11 in which said bag includes means to suspend said bag from its opening within said compactor.

13. The method of compacting liquid laden trash comprising the steps of placing said trash in an open end bag made from a porous fabric of non-wetting material capable of containing said liquid in the absence of the application of pressure, inserting said bag open end up into a compactor and supporting said bag for suspension from said open end, closing said compactor, crushing said bag with a plate activated by differential air pressure caused by reducing the pressure on the side of said plate facing said bag, said liquid seeping out of said bag through the fabric thereof, retracting said plate, and thereafter removing said bag and sealing said opening.

14. The method of claim 13 in which said bag is crushed by said plate against a wall of said compactor.

15. The method of claim 14 in which said bag includes means adapted to mount same within said compactor, said means including means to grasp said bag and to seal same after removal from said compactor.

16. The method of claim 15 in which support of said receptable shifts from the mounting means to said compactor as said bag becomes filled with trash.

* * * * *